US008967764B2

(12) United States Patent
Nagase

(10) Patent No.: US 8,967,764 B2
(45) Date of Patent: Mar. 3, 2015

(54) INK JET TEXTILE PRINTING APPARATUS AND METHOD OF PRODUCING PRINTED TEXTILE

(75) Inventor: Makoto Nagase, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/421,670

(22) Filed: Mar. 15, 2012

(65) Prior Publication Data

US 2012/0236069 A1 Sep. 20, 2012

(30) Foreign Application Priority Data

Mar. 16, 2011 (JP) ..... 2011-058362

(51) Int. Cl.
*B41J 2/015* (2006.01)
*B41J 3/407* (2006.01)
*B41J 11/00* (2006.01)

(52) U.S. Cl.
CPC ..... *B41J 3/4078* (2013.01); *B41J 11/0015* (2013.01)
USPC ..... 347/20

(58) Field of Classification Search
CPC ..... B41J 11/0015; B41J 3/4078; B41J 2/015
USPC ..... 347/20, 95, 98, 99, 100, 106
See application file for complete search history.

(56) References Cited

U.S. PATENT DOCUMENTS

| | | | | |
|---|---|---|---|---|
| 6,513,897 | B2 * | 2/2003 | Tokie | 347/15 |
| 7,166,690 | B2 * | 1/2007 | Kim | 528/480 |
| 2009/0011200 | A1 | 1/2009 | Souma et al. | |
| 2009/0123675 | A1 * | 5/2009 | Shaw-Klein et al. | 428/32.25 |
| 2009/0295847 | A1 * | 12/2009 | Mukai et al. | 347/6 |
| 2010/0227948 | A1 * | 9/2010 | Nagase et al. | 523/221 |

FOREIGN PATENT DOCUMENTS

| | | |
|---|---|---|
| CN | 101338528 | 1/2009 |
| JP | 06-010278 | 1/1994 |
| JP | 2009-057452 | 3/2009 |
| JP | 2009-215506 | 9/2009 |
| JP | 2010-189626 | 9/2010 |

* cited by examiner

*Primary Examiner* — Alessandro Amari
*Assistant Examiner* — Michael Konczal
(74) *Attorney, Agent, or Firm* — Workman Nydegger

(57) ABSTRACT

An ink jet textile printing apparatus includes a textile printing head having a nozzle line for discharging a coating solution containing an abrasion resistance-improving resin in a content of A and a textile printing head having a nozzle line for discharging an ink containing the abrasion resistance-improving resin in a content of B, wherein the content A and the content B satisfy a relationship of A>B.

10 Claims, 6 Drawing Sheets

INK JET TEXTILE PRINTING APPARATUS AND METHOD OF PRODUCING PRINTED TEXTILE

This Application claims the benefit of Japanese Patent Application No. 2011-58362, filed on Mar. 16, 2011, which is hereby incorporated by reference herein in its entirety.

BACKGROUND

1. Technical Field

The present invention relates to an ink jet textile printing apparatus for performing textile printing on a textile material such as cotton, silk, wool, chemical fabric, and blended fabric by ejecting an ink from an ink jet recording head and relates to a method of producing a printed textile.

2. Related Art

In the case of performing textile printing on fabric of, for example, cotton, silk, wool, chemical fiber, or blended fiber, a screen textile printing method using a dyeing stencil or a roller textile printing method using an engraved roller on which a pattern is engraved is employed. Since these textile printing methods use an expensive dyeing stencil or engraved roller, the printed textiles other than mass product fail to match the cost.

On the other hand, textile printing by an ink jet system does not need the dyeing stencil and the engraved roller and is performed using digital data for design. Accordingly, a small volume of printing is possible, and also it is possible to quickly cope with a small change in design and possible to largely reduce throughput time. Furthermore, the textile printing by an ink jet system has an advantage of high freedom in design such that color gradation can be expressed. For example, a small volume of an original product can be easily produced by printing an image such as a photograph based on digital data thereof on clothes such as a T-shirt or a small article made of fabric.

From the above-mentioned points, an ink jet textile printing method performing printing by an ink jet system has been being focused.

In the ink jet textile printing, an ink of pigment or dye is used. The pigment ink is inferior to the dye ink in color tone and clearness, but pre-treatment of a textile material, which is necessary in the dye ink, is not necessary in the pigment, and also the pigment is superior to the dye in fixability to fibers. In addition, though the textile material on which the dye can be printed is limited, the pigment allows printing on various textile materials, and, thereby, textile printing using pigments is being focused.

However, pigments have a problem in that the pigments tend to detach after printing, while dyes fix to fibers of a textile material at the molecular level.

Incidentally, the above-mentioned clothes and other clothing products are frequently washed, and in many cases, the printed portions are rubbed by wearing or using them. Accordingly, in textile printing on fabric such as clothes and other clothing products, ink properties such as washing fastness, abrasion resistance, and fixability are required.

In light of this point, JP-A-2009-215506 and JP-A-2009-057452 disclose that ink properties such as the above-mentioned washing fastness, abrasion resistance, and fixability are improved by adding a resin to a pigment ink.

The degree of improvement in ink properties such as washing fastness, abrasion resistance, and fixability is correlated with the amount of the resin contained in the ink, and in order to obtain a sufficient degree of improvement in the ink properties, a large amount of resin is necessary. Incidentally, an ink that is used for printing on paper also contains a resin in order to enhance the abrasion resistance. However, in order to obtain abrasion resistance that is required in textile printing on, for example, fabric, the amount of the resin must be several times (about three to four times) larger than that of the resin that is contained in the ink for printing on paper. However, an increase in amount of the resin tends to cause problems such as an increase in ink viscosity and decreases in ink discharge stability and recovery performance from nozzle drying.

SUMMARY

An advantage of some aspects of the invention is to provide an ink jet textile printing apparatus that can perform textile printing with high image quality by an ink jet system on a textile material by improving washing fastness, abrasion resistance, and fixability and inhibiting occurrence of problems such as an increase in ink viscosity and decreases in ink discharge stability and recovery performance from nozzle drying through addition of a resin to an ink, and an advantage of some aspects of the invention is to provide a method of producing a printed textile.

The ink jet textile printing apparatus according to a first embodiment of the invention includes a textile printing head having a nozzle line for discharging a coating solution containing an abrasion resistance-improving resin in a content of A and a textile printing head having a nozzle line for discharging an ink containing the abrasion resistance-improving resin in a content of B, wherein the content A and the content B satisfy a relationship of A>B.

Throughout the invention, the term "textile material" refers to, for example, "fabric" and "clothes and other clothing products". The "fabric" includes woven fabric, knitted fabric, and nonwoven fabric of natural fiber such as cotton, silk, or wool, chemical fiber such as nylon, or conjugated fiber thereof, and may be long so as to be wound in a roll state or may be cut to a predetermined length.

The "clothes and other clothing products" include not only sewn products, for example, T-shirts, handkerchiefs, towels, carrier-bags, fabric bags and furniture such as curtains, sheets, and bed covers but also fabric before or after cutting into parts before sewing.

The "ink" is that for forming an image on a textile material and contains a coloring material. The "coating solution" does not contain a coloring material and can be used for forming a coating layer covering the surface of a textile material before printing by the ink or the surface of the printed ink. The "abrasion resistance-improving resin" is a resin that is added for improving the washing fastness, abrasion resistance, and fixability of an ink.

In this embodiment, the content A of the abrasion resistance-improving resin in the coating solution for forming the coating layer that covers the ink surface is set to be higher than the content B of the abrasion resistance-improving resin in the ink. Though the ink contains a coloring material as described above, the coating solution does not contain a coloring material. Accordingly, the coating solution can contain a larger amount of the abrasion resistance-improving resin even in considering the viscosity and ink discharge stability.

According to this embodiment, the amount of the abrasion resistance-improving resin contained in an ink is set to be low, and, as shown in FIG. 1, a coating layer 2 of the coating solution containing the abrasion resistance-improving resin in an amount larger than that in the ink is formed on the image (ink layer 3) after textile printing with the ink. By doing so, as the whole of the overlapped ink layer and coating layer, an abrasion resistance higher than that in the case of the content of B can be obtained.

For example, the addition of the abrasion resistance-improving resin to an ink at a content of C that is necessary for providing predetermined ink properties (such as washing fastness, abrasion resistance, and fixability) may increase the ink viscosity and decrease ink discharge stability and recovery performance from nozzle drying.

In such a case, it is possible to provide an abrasion resistance equal to or higher than that of an ink layer of the ink containing the abrasion resistance-improving resin at the content of C, as the total of an ink layer and a coating layer stacked, by setting the amount of the abrasion resistance-improving resin in the ink to a content B that is lower than the content C and satisfies predetermined ink discharge stability and recovery performance from nozzle drying and also setting the amount of the abrasion resistance-improving resin in the coating solution to a content A. That is, though the content of the abrasion resistance-improving resin in the ink is set to be lower than the content C, the abrasion resistance as the whole image obtained by textile printing can be equal to or higher than the abrasion resistance obtained when the content is C.

In the ink jet textile printing apparatus according to a second embodiment of the invention, the apparatus according to the first embodiment further includes a controller for controlling discharge of the coating solution and the ink. The controller has a textile printing mode for forming an image by repeating alternate discharge of the coating solution and the ink.

According to this embodiment, in addition to the effects in the first embodiment, as shown in FIGS. 2A and 2B, it is possible to form an image by alternately stacking the ink layers 3 and the coating layers 2. For example, in the case of forming an image by one ink layer 3 and one coating layer 2 as shown in FIG. 1, the ground color of the textile material may shortly appear because of detachment of the coating layer 2 and the ink layer 3 by using or washing the printed textile.

Contrarily, in the case of textile printing that alternately stacks the ink layers 3 and the coating layers 2 to form an image by a plurality of the ink layers 3*a*, 3*b*, and 3*c* and a plurality of the coating layers 2*a*, 2*b*, and 2*c*, even if the uppermost layer, the ink layer 3*c*, is detached by the use or washing, the ink layer 3*b* under the ink layer 3*c* appears to prevent the image from being shortly degraded. Consequently, the printed image can be maintained in a beautiful state for a long time.

The plurality of the ink layers when the ink layers and the coating layers are alternately stacked may be formed with an ink of one color or with inks of two or more colors (see FIG. 4). By doing so, it can be expected to express a color different from that by stacking an ink of one color.

In the ink jet textile printing apparatus according to a third embodiment of the invention, the controller in the second embodiment has a coating mode for forming a coating layer by the coating solution.

According to this embodiment, in addition to the effects in the second embodiment, an under coating layer 6 can be formed on the surface of a textile material on which an image is printed prior to formation of the image by alternately stacking the ink layers and the coating layers as described above (see FIG. 3B). The fixability and the washing fastness can be increased by previously forming the under coating layer 6 containing the abrasion resistance-improving resin in an amount larger than that in the ink on the textile material. In addition, difference of color development due to a difference in color or kind of the textile material can be prevented.

Furthermore, it is possible to form a top coating layer 5 having a predetermined thickness on the image surface by performing the coating mode after the textile printing (see FIGS. 3A and 3B). The abrasion resistance, fixability, and washing fastness can be further increased by reliably covering the uppermost layer of the printed image with the top coating layer 5.

In the ink jet textile printing apparatus according to a fourth embodiment of the invention, the controller in the second or third embodiment further has a bordering mode for forming a border of the coating layer at the edge of the image.

According to this embodiment, a border 7 (see FIG. 5) of the coating layer can be formed at the edge of an image to be printed, prior to formation of the image of alternately stacked ink layers and coating layers. Consequently, it is possible to emphasize the color development at the edge of the image and to form a clear image by textile printing.

In the ink jet textile printing apparatus according to a fifth embodiment of the invention, in any one of the first to fourth embodiments, the ink is composed of a coloring material, an abrasion resistance-improving resin, and other components including at least a solvent, and the coating solution does not contain the coloring material and is composed of the abrasion resistance-improving resin in an amount larger than that in the ink and other components in the same composition as that in the ink.

According to this embodiment, the coating solution can contain the abrasion resistance-improving resin in a larger amount by the amount of the coloring material in the ink, which is not contained in the coating solution. In addition, the physical nature of the coating solution is similar to that of the ink when the composition of the components other than the coloring material and the abrasion resistance-improving resin of the coating solution is the same as that of the ink. Consequently, the ink layer and the coating layer stacked by printing are easily unified.

In the method of producing a printed textile according to a sixth embodiment of the invention, the printed textile is produced by performing textile printing with the ink jet textile printing apparatus according to any one of the first to fifth embodiment.

According to this embodiment, the same effects as in any one of the first to fifth embodiments can be achieved, and it is possible to inhibit the problems, such as an increase in ink viscosity and decreases in ink discharge stability and recovery performance from nozzle drying, in ink jet textile printing on a textile material and thereby to obtain a high-image-quality printed textile excellent in washing fastness, abrasion resistance, and fixability.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
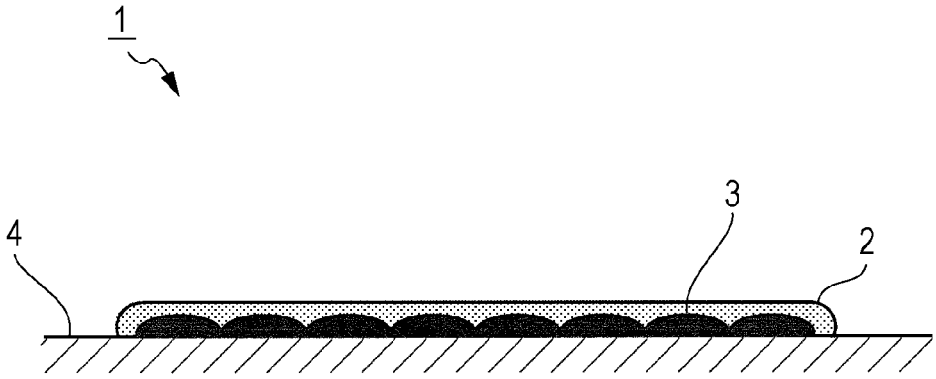
FIG. 1 is an enlarged diagram illustrating a configuration of a printed textile for describing textile printing using the ink jet textile printing apparatus according to an aspect of the invention.

The invention will now be described in detail with reference to examples, but is not limited thereto.

An ink and a coating solution used in the ink jet textile printing apparatus according to an aspect of the invention will be described below.

Ink

The ink is composed of a coloring material, an abrasion resistance-improving resin, and other components including at least a solvent. In textile printing, a pigment ink, which is excellent in storage stabilities such as light resistance and water resistance, is preferably used, and known pigments, that is, for example, organic pigments, inorganic materials, and carbon blacks can be used as the coloring material.

For example, particularly preferred pigments for black ink are carbon blacks (C.I. Pigment Black 7) such as furnace black, lamp black, acetylene black, and channel black. Metals such as copper oxide, iron oxide (C.I. Pigment Black 11), and titanium oxide and organic pigments such as aniline black (C.I. Pigment Black 1) can also be used.

As pigments for color inks, for example, C.I. Pigment Yellow 1 (Fast Yellow G), 3, 12 (disazo yellow AAA), 13, 14, 17, 24, 34, 35, 37, 42 (yellow iron oxide), 53, 55, 74, 81, 83 (disazo yellow HR), 93, 94, 95, 97, 98, 100, 101, 104, 108, 109, 110, 117, 120, 128, 138, 153, 155, 180, and 185; C.I. Pigment Red 1, 2, 3, 5, 17, 22 (brilliant fast scarlet), 23, 31, 38, 48:2 (permanent red 2B (Ba)), 48:2 (permanent red 2B (Ca)), 48:3 (permanent red 2B (Sr)), 48:4 (permanent red 2B (Mn)), 49:1, 52:2, 53:1, 57:1 (brilliant carmine 6B), 60:1, 63:1, 63:2, 64:1, 81 (rhodamine 6G lake), 83, 88, 101 (iron oxide red), 104, 105, 106, 108 (cadmium red), 112, 114, 122 (quinacridone magenta), 123, 146, 149, 166, 168, 170, 172, 177, 178, 179, 185, 190, 193, 202, 206, 209, and 219; C.I. Pigment Violet 19 and 23; C.I. Pigment Orange 36; C.I. Pigment Blue 1, 2, 15 (phthalocyanine blue R), 15:1, 15:2, 15:3 (phthalocyanine blue G), 15:4, 15:6 (phthalocyanine blue E), 16, 17:1, 56, 60, and 63; and C.I. Pigment Green 1, 4, 7, 8, 10, 17, 18, and 36 can be used.

The content of the coloring material in the ink is preferably 0.5% to 30%, more preferably 1.0% to 15%. A content of less than this range cannot secure a concentration for printing, and a content of higher than this range causes an increase in viscosity of the ink or a structural viscosity in the viscosity characteristics, and thereby the discharge stability of the ink being discharged from the ink jet textile printing head tends to be deteriorated.

Next, the abrasion resistance-improving resin will be described. The abrasion resistance-improving resin according to an aspect of the invention is a resin that is added to an ink for improving the washing fastness, abrasion resistance, and fixability of the ink, and a known resin, for example, a resin component described in JP-A-2006-307165 can be used. Specifically, a resin component composite of a hydrophilic resin and a hydrophobic resin can be used. As the hydrophilic resin, for example, a styrene acrylic resin, silicone resin, polyester resin, or urethane resin having a hydrophilic group such as a carboxyl group or a sulfone group can be used. As the hydrophobic resin, for example, a styrene acrylic resin, silicone resin, polyester resin, or urethane resin showing hydrophobicity can be used.

Furthermore, the abrasion resistance-improving resin can be produced by a known method, for example, by the method described in JP-A-2010-189626 (a method of producing polymer microparticles).

The abrasion resistance-improving resin preferably has a glass transition temperature of 0° C. or less. By using such a resin, the fixability of a pigment is improved as an ink for textile printing. In the range of higher than 0° C., the fixability of a pigment gradually decreases with an increase of the glass transition temperature. The glass transition temperature is preferably −5° C. or less, more preferably −10° C. or less. The abrasion resistance-improving resin preferably also has an acid value of 100 mg KOH/g or less. An acid value higher than 100 mg KOH/g decreases the washing fastness of the ink printed on a textile material. The acid value is preferably 50 mg KOH/g or less, more preferably 30 mg KOH/g or less. Furthermore, the abrasion resistance-improving resin preferably has a molecular weight of 100000 or more, more preferably 200000 or more. A molecular weight of less than 100000 decreases the washing fastness of the ink printed on a textile material.

The content B of the abrasion resistance-improving resin in the ink (hereinafter, "content B" refers to the content of the abrasion resistance-improving resin in an ink) is preferably 10% by weight or less. In a content B of 10% by weight or less, the ink is prevented from solidifying in the nozzle of a textile printing head and can have a viscosity that allows stable discharge of the ink. The content B of the abrasion resistance-improving resin in an ink used in the invention will be described in more detail in the description of the content A of the abrasion resistance-improving resin in the coating solution below.

Next, other components than the coloring material and the abrasion resistance-improving resin will be described. The other components include at least a solvent and can be composed of, for example, a solvent such as 1,2-hexanediol, butyl triglycol, glycerin, trimethylolpropane, triethylene glycol, or triethanolamine, a surfactant, and deionized water. As the surfactant, for example, a known surfactant such as acetylene glycol or acetylene alcohol can be used (see, for example, JP-A-2010-189626).

The ink further contains various types of additives, such as a humectant, a dissolution aid, a penetration controlling agent, a viscosity modifier, a pH adjustor, a dissolution aid, an antioxidant, a preservative, an antifugal agent, a corrosion inhibitor, and a chelate for capturing metal ions that influence the dispersion, for the purposes of securing of storage stability, stable discharge from an ink jet head, a reduction in clogging, prevention of ink degradation, and so on.

Coating Solution

The coating solution used in the invention does not contain the coloring material, unlike the above-described ink, and can be used for forming a coating layer covering the textile material surface before textile printing or the ink surface after textile printing. The coating solution can contain the same components as those of the ink excluding the coloring material, that is, the abrasion resistance-improving resin and the "other components than the coloring material and the abrasion resistance-improving resin" in the description of the ink. In particular, it is preferable that the composition (for example, % by weight of each component) of the other components in the coating solution be also the same as that of the ink.

Specific content A of the abrasion resistance-improving resin in the coating solution used in the invention (hereinafter, "content A" refers to the content of the abrasion resistance-improving resin in the coating solution) is set to be higher than the above-mentioned content B of the abrasion resistance-improving resin in the ink. As described above, though the ink contains the coloring material, the coating solution does not contain the coloring material. Accordingly, the coating solution can contain the abrasion resistance-improving resin in a larger amount even in considering the viscosity and ink discharge stability.

Consequently, an abrasion resistance higher than the abrasion resistance obtained by the content B can be obtained as the total of stacked ink layer and coating layer by forming the ink layer of an ink of which content B being set to be low and the coating layer of a coating solution containing the abrasion resistance-improving resin at the content A set to be larger than the content B. The content A of the abrasion resistance-improving resin in the coating solution is preferably 15% by weight or less, more preferably 10% by weight or less.

When the content B of the abrasion resistance-improving resin in an ink and the content A of the abrasion resistance-improving resin in a coating solution satisfy a relationship A>B, the following composition is possible.

For example, when the content of the abrasion resistance-improving resin necessary for imparting predetermined ink properties (such as washing fastness, abrasion resistance, and fixability) to an ink is C, in the case of an ink containing the abrasion resistance-improving resin in this content C, the ink viscosity may increase and the ink discharge stability and recovery performance from nozzle drying may decrease.

In such a case, it is possible to set the content B of the ink and the content A of the coating solution such that the content B is lower than the content C and satisfies predetermined ink discharge stability and recovery performance from nozzle drying and that the content A allows to obtain an abrasion resistance, as the total of the coating layer and the ink layer, equal to or higher than that of the ink layer of an ink containing the abrasion resistance-improving resin at the content of C. That is, though the content B of the abrasion resistance-improving resin in the ink is set to be lower than the content C, the abrasion resistance as the whole image obtained by textile printing can be equal to or higher than the abrasion resistance obtained at the content of C.

In a specific example, the content of the abrasion resistance-improving resin necessary for imparting the predetermined ink properties to an ink is usually 3 or more as a ratio to the pigment mass. For example, when the pigment concentration in an ink is 4.5% by weight, the content C is 13.5% by weight or more. However, if the ink contains 10% by weight or more of the abrasion resistance-improving resin, the discharge stability of the ink tends to be deteriorated. Here, for example, when the content B of the abrasion resistance-improving resin in an ink is set to 7% by weight and the content A of the abrasion resistance-improving resin in a coating solution is set to 9% by weight, though the mass ratio of the abrasion resistance-improving resin to the pigment in the ink is about 1.6, the mass ratio can be raised to 3 or more (about 3.6) due to the content A in the coating solution. In addition, since the content of the abrasion resistance-improving resin in each of the coating solution and the ink is less than 10% by weight, the tendency of a decrease in discharge stability of these solutions can be reduced.

Table shows an example of the component composition of an ink and a coating solution used in the invention.

TABLE

| Component | Ink (% by weight) | Coating solution (% by weight) |
|---|---|---|
| Coloring material (pigment: solid content) | 0.8 to 4.5 | 0 |
| Abrasion resistance-improving resin | 3 to 7 | 9 |
| 1,2-Hexanediol | 2 | 2 |
| Butyl triglycol | 1 | 1 |
| Acetylene glycol surfactant | 0.8 | 0.8 |
| Glycerin | 13 to 15 | 13 |
| Trimethylolpropane | 3 | 3 |
| Triethylene glycol | 5 | 5 |
| Triethanolamine | 1 | 1 |
| Deionized water | Residual quantity | Residual quantity |

Example 1

Figure 7:
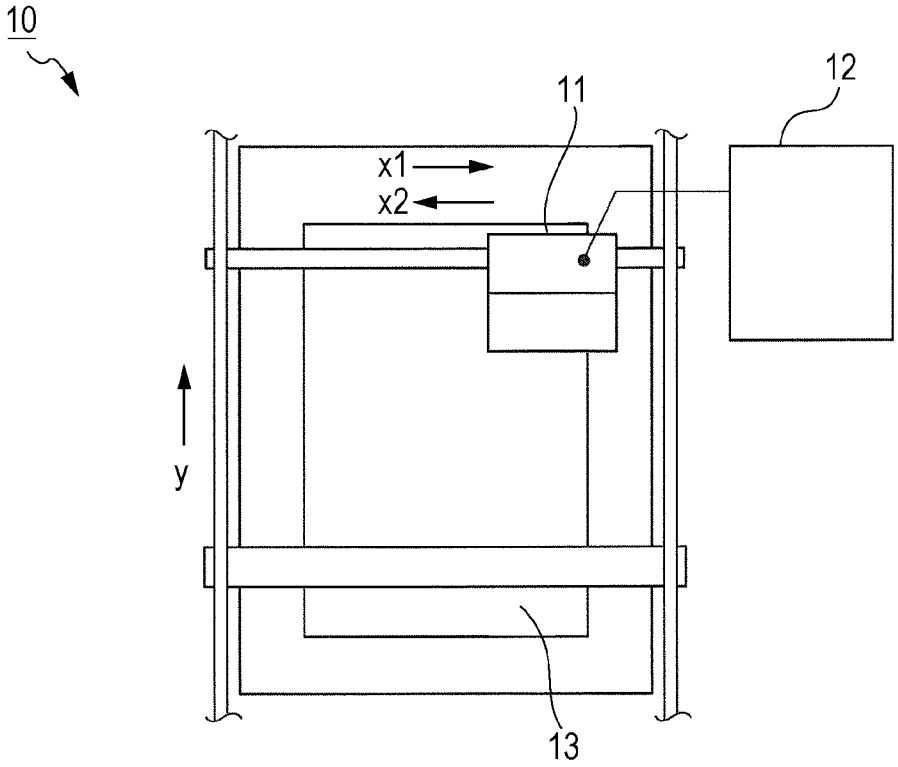
FIG. 7 is a schematic diagram illustrating an example of the ink jet textile printing apparatus according to an aspect of the invention.
Figure 8:
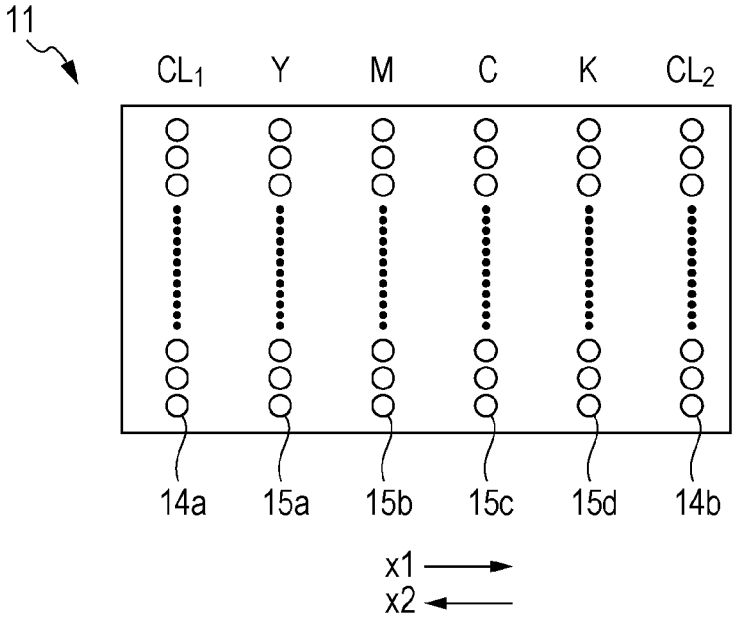
FIG. 8 is a plan view showing an example of the textile printing head used in the ink jet textile printing apparatus according to an aspect of the invention.

Embodiments according to the invention will now be described with reference to the drawings. FIG. 7 is a schematic diagram illustrating an example of the ink jet textile printing apparatus according to an aspect of the invention. FIG. 8 is a plan view showing an example of the textile printing head used in the ink jet textile printing apparatus according to an aspect of the invention.

The ink jet textile printing apparatus 10 according to an aspect of the invention includes a textile printing head 11 that can perform bidirectional printing and a controller 12 that controls the discharge of the coating solution and the ink from nozzle lines provided to the textile printing head 11. In the drawing, x1 and x2 indicate the movement directions of the textile printing head, and y indicates the transfer direction of the textile material 13 on which textile printing is performed.

As shown in FIG. 8, the textile printing head 11 includes a nozzle line 14*a* and a nozzle line 14*b* for discharging the coating solutions ($CL_1$ and $CL_2$) and a nozzle line 15*a*, a nozzle line 15*b*, a nozzle line 15*c*, and a nozzle line 15*d* for discharging inks of the respective colors (Y, M, C, and K). Each nozzle line is disposed so as to orthogonal to the axial direction (the movement direction x1 and the movement direction x2 of the textile printing head) of the carriage to which the textile printing head 11 is provided. The nozzle lines 15*a* to 15*d* for discharging inks are disposed between the nozzle lines 14*a* and 14*b* for discharging the coating solutions. By thus disposing the nozzle lines, it is possible to continuously discharge the coating solutions and the inks to form coating layers and ink layers in a stacked state in each of the movement directions x1 and x2 of the textile printing head.

In the textile printing head 11 shown in FIG. 8, the nozzle lines 14*a* and 14*b* for discharging the coating solutions and the nozzle lines 15*a* to 15*d* for discharging the inks of the respective colors are provided to one textile printing head 11, but a textile printing head having the nozzle lines 14*a* and 14*b* for discharging the coating solutions and a textile printing head having the nozzle lines 15*a* to 15*d* for discharging the inks of the respective colors may be separately provided.

The coating solution and the ink used in the ink jet textile printing apparatus 10 of this Example are a coating solution containing the abrasion resistance-improving resin at a content of A and an ink containing the abrasion resistance-improving resin at a content of B as described above, and the content A and the content B satisfy a relationship of A>B.

The controller 12 for controlling discharge of the coating solution and the ink has a textile printing mode for forming an image by repeating alternate discharge of the coating solution and the ink.

Furthermore, the controller 12 has a coating mode for forming a coating layer by the coating solution and a bordering mode for forming a border of the coating layer at the edge of the image to be formed in the textile printing mode.

Figure 6:
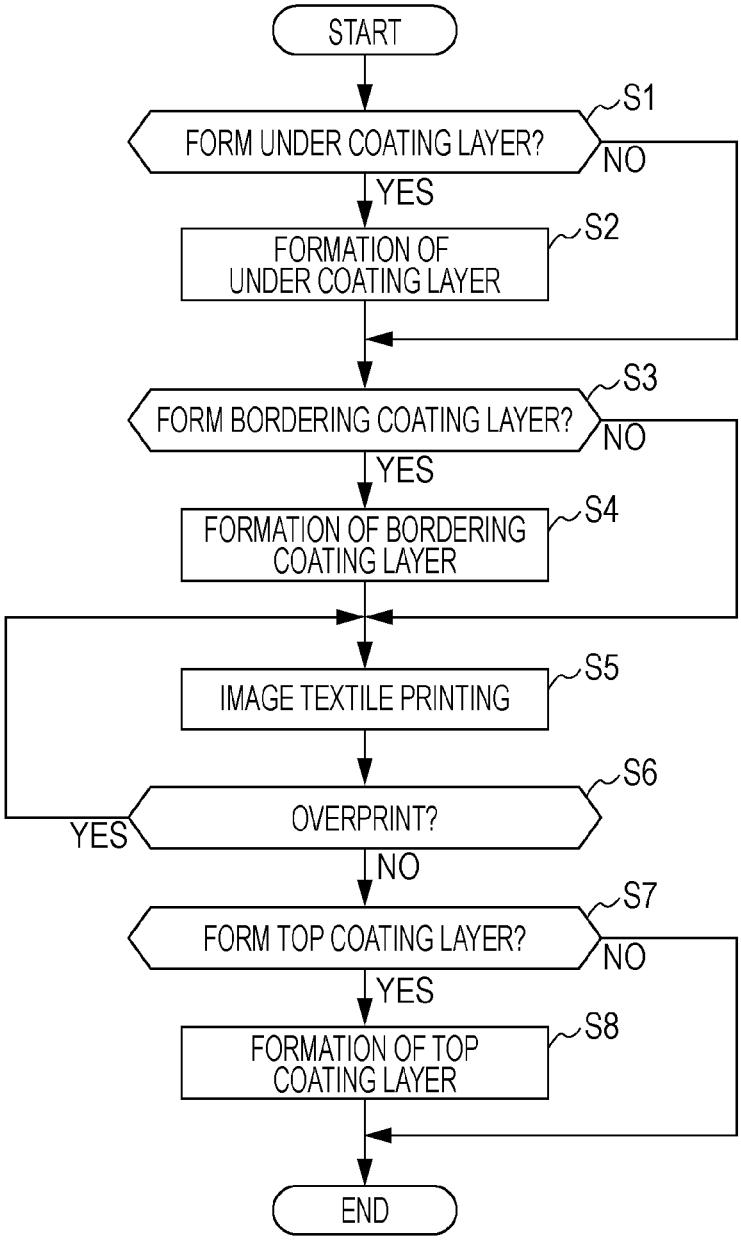
FIG. 6 is a flow chart describing the textile printing using the ink jet textile printing apparatus according to an aspect of the invention.

Next, a method of producing a printed textile using the ink jet textile printing apparatus according to an aspect of the invention will be described with reference to FIG. 6. FIG. 6 is a flow chart describing the textile printing using the ink jet textile printing apparatus according to an aspect of the invention.

In textile printing of an image on a textile material, first of all, step S1 is performed to judge whether coating of the textile material surface by a coating solution (formation of under coating layer) is performed or not. In the case of performing the coating (in the case of YES in step S1), the process proceeds to step S2 for discharging only the coating solution from the textile printing head 11 to form a coating layer (undercoat) on the textile material surface at a portion where an image will be printed, and then the process proceeds to step S3. In the case of not performing the coating (in the case of NO in step S1), the process proceeds to step S3 directly.

Subsequently, step S3 is performed to judge whether bordering at the edge of an image to be printed is formed by a coating layer or not. In the case of performing the bordering (in the case of YES in step S3), only the coating solution is discharged from the textile printing head 11 to form a coating layer at the portion corresponding to the edge of an image to be printed (step S4), and then the process proceeds to step S5. In the case of not performing the bordering (in the case of NO in step S3), the process proceeds to step S5 directly.

Subsequently, step S5 is performed to form an image by an ink. In step S5, the ink and the coating solution are discharged from each nozzle line of the textile printing head 11 in the order of the ink and then the coating solution or the coating solution and then the ink for stacking one ink layer and one coating layer to form an image. Subsequently, step S6 is performed to judge whether textile printing by "overprint" of an ink layer and a coating layer on the ink layer and the coating layer formed in step S5 is further formed or not.

In the case of performing the textile printing by overprinting (in the case of YES in step S6), step S5 is performed again. In the case of not performing the textile printing by overprinting (in the case of NO in step S6), the process proceeds to step S7.

Subsequently, step S7 is performed to judge whether coating of the surface of the image formed in step S5 by a coating solution (formation of top coating layer) is performed or not. In the case of performing the coating (in the case of YES in step S7), step S8 for forming a coating layer on the image surface by discharging only the coating solution from the textile printing head 11 is performed, and the textile printing is ended. In the case not performing the coating (in the case of NO in step S7), the textile printing is ended without forming the top coating layer.

According to the process described above, in a printed textile 1 produced by the ink jet textile printing apparatus 10 according to an aspect of the invention, as shown in FIG. 1, a coating layer 2 of a coating solution containing the abrasion resistance-improving resin in an amount larger than that in the ink is formed on an image (ink layer 3) after textile printing of the ink, and as the total of the stacked ink layer 3 and coating layer 2, an abrasion resistance higher than that obtained by the content B of the abrasion resistance-improving resin contained in the ink layer can be obtained.

Figure 2A:
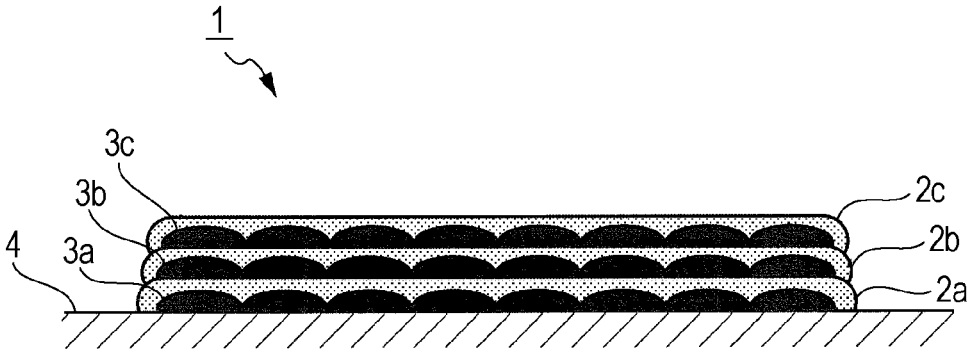
FIG. 2A is an enlarged diagram illustrating a configuration of another printed textile produced using the ink jet textile printing apparatus according to an aspect of the invention by forming an ink layer and then repeating textile printing of coating layers and ink layers.
Figure 2B:
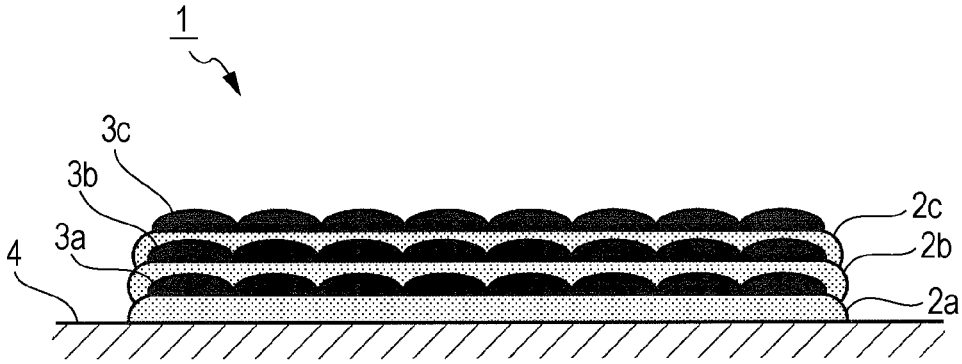
FIG. 2B is an enlarged diagram illustrating a configuration of another printed textile produced using the ink jet textile printing apparatus by forming a coating layer and then repeating textile printing of ink layers and coating layers.

In addition, in the case of performing textile printing by the "overprint", as shown in FIG. 2A or 2B, a printed textile 1 where the image is formed by alternately stacking the ink layers 3 and the coating layers 2 is obtained. In the case of forming an image by one ink layer 3 and one coating layer 2 as shown in FIG. 1, the ground color of the textile material may shortly appear because of detachment of the coating layer 2 and the ink layer 3 by using or washing the printed textile.

However, as shown in FIG. 2A or 2B, in the case of textile printing by alternately stacking the ink layers 3 and the coating layers 2 to form an image by a plurality of the ink layers 3*a*, 3*b*, and 3*c* and a plurality of the coating layers 2*a*, 2*b*, and 2*c*, even if the ink layer 3*c*, that is, the uppermost layer of the ink layers, is detached by the use or washing, the ink layer 3*b* under the ink layer 3*c* appears to prevent the image from being shortly degraded. Consequently, the printed image can be maintained in a beautiful state for a long time.

Figure 4:
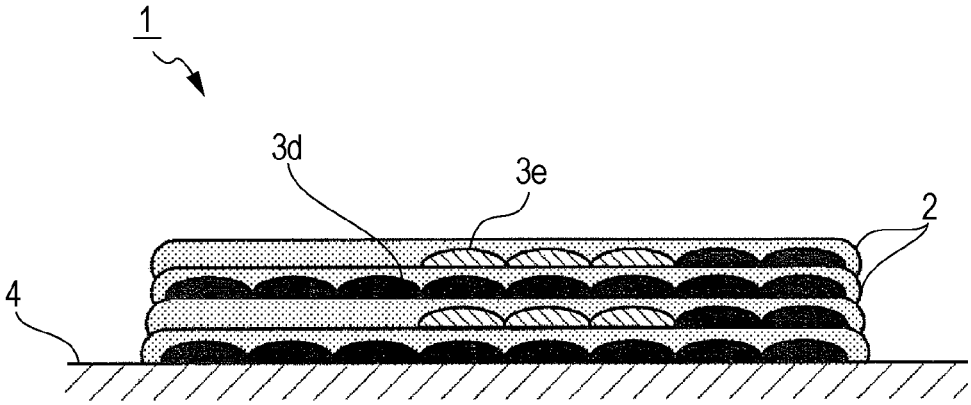
FIG. 4 is an enlarged diagram illustrating a configuration of a printed textile in the case of forming ink layers of two colors in a plurality of stacked ink layers.

In the case of performing the "overprint" by repeating step S5 and step S6, as shown in FIG. 4, inks of different two or more colors (e.g., ink 3*d* and ink 3*e*) may be overprinted. By doing so, it can be expected to express a color different from that by stacking an ink of one color. Furthermore, as shown in FIG. 4, the image may have a portion where the ink layers are not stacked by partially stacking the ink layer and the coating layers in the order of the ink layer, the coating layer, and then the coating layer.

Figure 3A:
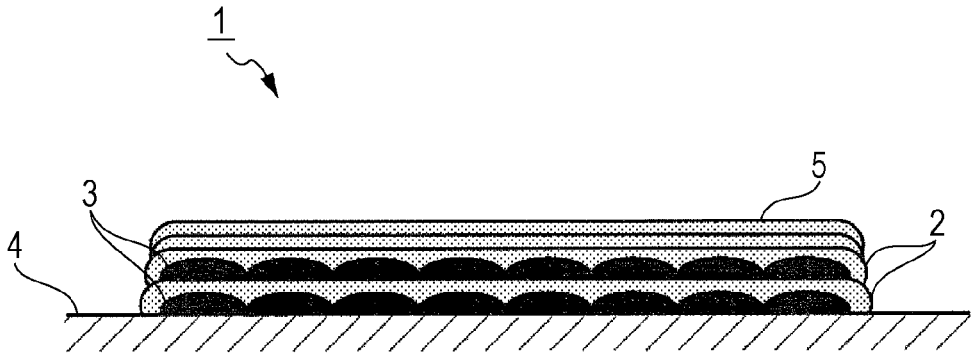
FIG. 3A is an enlarged diagram illustrating a configuration of a printed textile in the case of performing surface coating after textile printing of an image.
Figure 3B:
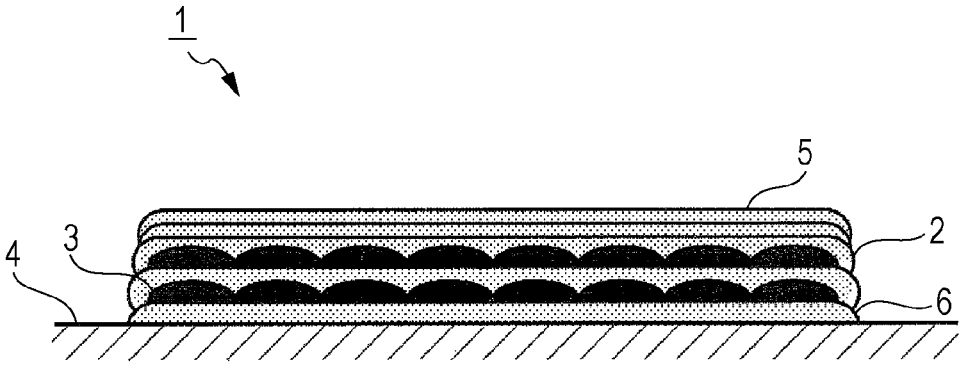
FIG. 3B is an enlarged diagram illustrating a configuration of a printed textile in the case of performing surface coating of a textile material before textile printing of an image and performing surface coating after textile printing of the image.

Furthermore, as shown in FIG. 3B, in the case of coating the surface of a textile material 4 by the under coating layer 6 prior to performing textile printing, since the under coating layer 6 contains the abrasion resistance-improving resin in an amount larger than that in the ink, the fixability and the washing fastness can be further increased. In addition, difference of color development due to a difference in color or kind of the textile material 4 can be prevented.

Furthermore, as shown in FIGS. 3A and 3B, in the case of coating the printed image surface by the top coating layer 5, the top coating layer 5 reliably covers the uppermost layer of the printed image to further increase the abrasion resistance, the fixability, and the washing fastness.

Figure 5:
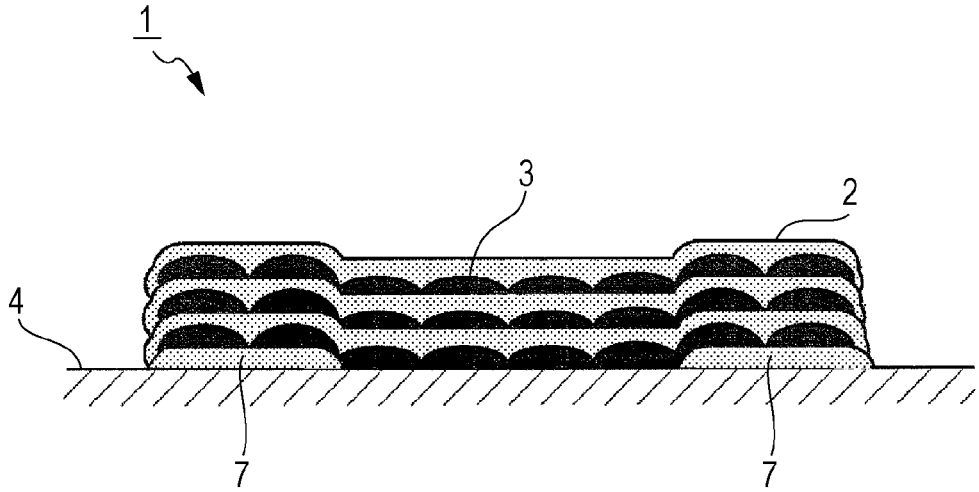
FIG. 5 is an enlarged diagram illustrating a configuration of a printed textile in the case of forming a coating layer on a textile material surface at a portion corresponding to the edge of an image to be formed by textile printing.

Furthermore, as shown in FIG. 5, in the case of forming the border 7 of the coating layer 7 at the edge (end) of an image to be formed by textile printing prior to the textile printing, it is possible to emphasize the color development at the edge of the image and to form a clear image by textile printing.

According to the ink jet textile printing apparatus and the method of producing a printed textile according to aspects of the invention described above, it is possible to reduce problems in textile printing of an ink jet system, such as an increase in ink viscosity, a decrease in ink discharge stability, and a decrease in recovery performance from nozzle drying, and thereby to provide a high-image-quality printed textile excellent in washing fastness, abrasion resistance, and fixability.

What is claimed is:

1. An ink jet textile printing apparatus for printing an ink onto a textile, the apparatus comprising:

a textile printing head having a nozzle line for discharging a coating solution containing an abrasion resistance-improving resin in a content of A, the abrasion resistance-improving resin has an acid value of 100 mg KOH/g or less; and a textile printing head having a nozzle line for discharging an ink onto the textile, the ink containing the abrasion resistance-improving resin in a content of B, wherein the content A of the abrasion resistance-improving resin and the content B of the same abrasion resistance-improving resin satisfy a relationship of A>B and the ink contains a coloring material and the coating solution does not contain coloring material, each of the content A and content B being in an amount of less than 10% by weight and a % by weight of a combination of the content A and the content B being three times or more, as a ratio, of a % by weight of the coloring material.

2. The ink jet textile printing apparatus according to claim 1, the apparatus further comprising a controller for controlling discharge of the coating solution and the ink, wherein the controller has a textile printing mode for forming an image by repeating alternate discharge of the coating solution and the ink.

3. The ink jet textile printing apparatus according to claim 2, wherein the controller has a coating mode for forming a coating layer by the coating solution.

4. The ink jet textile printing apparatus according to claim 2, wherein the controller further has a bordering mode for forming a border of the coating layer at the edge of the image.

5. The ink jet textile printing apparatus according to claim 1, wherein the ink further comprises other components including at least a solvent; and the coating solution is composed of the abrasion resistance-improving resin in an amount larger than that in the ink and the other components including the solvent in the same composition as that in the ink, without the coloring material.

6. A method of producing a printed textile the method comprises:

providing an ink jet textile printing apparatus comprising:

a textile printing head having a nozzle line for discharging a coating solution containing an abrasion resistance-improving resin in a content of A, the abrasion resistance-improving resin has an acid value of 100 mg KOH/g or less; and a textile printing head having a nozzle line for discharging an ink onto the textile, the ink containing the abrasion resistance-improving resin in a content of B, wherein the content A of the abrasion resistance-improving resin and the content B of the same abrasion resistance-improving resin satisfy a relationship of A>B and the ink contains a coloring material and the coating solution does not contain coloring material, each of the content A and content B being in an amount of less than 10% by weight and a % by weight of a combination of the content A and the content B being three times or more, as a ratio, of a % by weight of the coloring material; and performing textile printing with the ink jet textile printing apparatus.

7. The method of producing the printed textile as recited in claim 6, wherein the ink jet textile printing apparatus further comprises a controller for controlling discharge of the coating solution and the ink, wherein the controller has a textile printing mode for forming an image by repeating alternate discharge of the coating solution and the ink.

8. The method of producing the printed textile of claim 7, wherein the controller has a coating mode for forming a coating layer by the coating solution.

9. The method of producing the printed textile as recited in claim 7, wherein the controller further has a bordering mode for forming a border of the coating layer at the edge of the image.

10. The method of producing the printed textile as recited in claim 6, wherein the ink further comprises other components including at least a solvent; and the coating solution is composed of the abrasion resistance-improving resin in an amount larger than that in the ink and the other components including the solvent in the same composition as that in the ink, without the coloring material.

* * * * *